US006527522B2

(12) United States Patent
Chen

(10) Patent No.: US 6,527,522 B2
(45) **Date of Patent: *Mar. 4, 2003**

(54) HEAT DISSIPATION FAN STRUCTURE

(75) Inventor: Chien-Jung Chen, Kaohsiung (TW)

(73) Assignee: Yen Sun Technology Corp. (TW)

( * ) Notice: Subject to any disclaimer, the term of this patent is extended or adjusted under 35 U.S.C. 154(b) by 15 days.

This patent is subject to a terminal disclaimer.

(21) Appl. No.: 09/897,612

(22) Filed: Jul. 3, 2001

(65) Prior Publication Data

US 2003/0007879 A1 Jan. 9, 2003

(51) Int. Cl.[7] ..... F04B 17/00; F04B 35/00
(52) U.S. Cl. ..... 417/355; 417/423.1; 310/91
(58) Field of Search ..... 417/354, 355, 417/423.1; 310/91; 361/699

(56) References Cited

U.S. PATENT DOCUMENTS 6,208,512 B1 * 3/2001 Goldowsky et al. ..... 361/699
6,246,140 B1 * 6/2001 Horng ..... 310/91
6,309,190 B1 * 10/2001 Chen ..... 417/423.1
2001/0043869 A1 * 11/2001 Horng ..... 417/354
2002/0090307 A1 * 7/2002 Cheng ..... 417/423.1

* cited by examiner

*Primary Examiner*—Teresa Walberg
*Assistant Examiner*—Leonid M Fastovsky
(74) *Attorney, Agent, or Firm*—Larson & Taylor, PLC

(57) ABSTRACT

A heat dissipation fan structure includes a base plate provided with an air outlet which is provided with a bottom plate. The bottom plate is provided with a drive circuit control member. The base plate is provided with a plurality of poles of an even number. Each pole is wound with a coil. An insulating layer is mounted between the pole and the coil. Poles having the same polarity are connected by the same connecting wire. An impeller is pivoted and rotated on the bottom plate. The impeller has a plurality of blades that may drive air to flow. A magnet ring is mounted on peripheral edges of the blades of the impeller, and may be induced with the poles wound with coils.

10 Claims, 6 Drawing Sheets

HEAT DISSIPATION FAN STRUCTURE

BACKGROUND OF THE INVENTION

1. Field of the Invention

The present invention relates to a heat dissipation fan structure, and more particularly to a heat dissipation fan structure which may be rotated more rigidly and stably. When the impeller of the heat dissipation fan structure is rotated, it is able to detect if the impeller is operated and rotated normally.

2. Description of the Related Art

A conventional heat dissipation fan structure in accordance with the prior art shown in FIG. 1 comprises a housing 90 containing therein a circuit board 91, and a stator 92. An impeller 93 has a central shaft 94 pivoted and rotated in the shaft tube 96 of the stator 92. A permanent magnet ring 95 is mounted on the impeller 93, and may be induced with the stator 92, so as to drive the impeller 93 to rotate.

However, the winding and assembling process of the coils of the stator 92 is more difficult, thereby increasing the cost of fabrication. In addition, the entire conventional heat dissipation fan structure has a thicker construction due to existence of the stator 92, so that it cannot satisfy the light and thin design.

Further, the central shaft 94 of the impeller 93 is pivoted and rotated in the shaft tube 96 of the stator 92. Thus, the impeller 93 cannot be rotated smoothly and stably. In addition, it is unable to detect if the impeller 93 is operated and rotated normally.

SUMMARY OF THE INVENTION

The primary objective of the present invention is to provide a heat dissipation fan structure which can be worked and assembled conveniently, and can reduce the cost of fabrication.

A secondary objective of the present invention is to provide a heat dissipation fan structure which may be rotated more rigidly and stably.

A further objective of the present invention is to provide a heat dissipation fan structure, wherein it is able to detect if the impeller is operated and rotated normally.

In accordance with the present invention, there is provided a heat dissipation fan structure, including a base plate provided with an air outlet which is provided with a bottom plate. The bottom plate is provided with a drive circuit control member. The base plate is provided with a plurality of poles of an even number. Each pole is wound with a coil. An insulating layer is mounted between the pole and the coil. Poles having the same polarity are connected by the same connecting wire. An impeller is pivoted and rotated on the bottom plate. The impeller has a plurality of blades that may drive air to flow. A magnet ring is mounted on peripheral edges of the blades of the impeller, and may be induced with the poles wound with coils.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
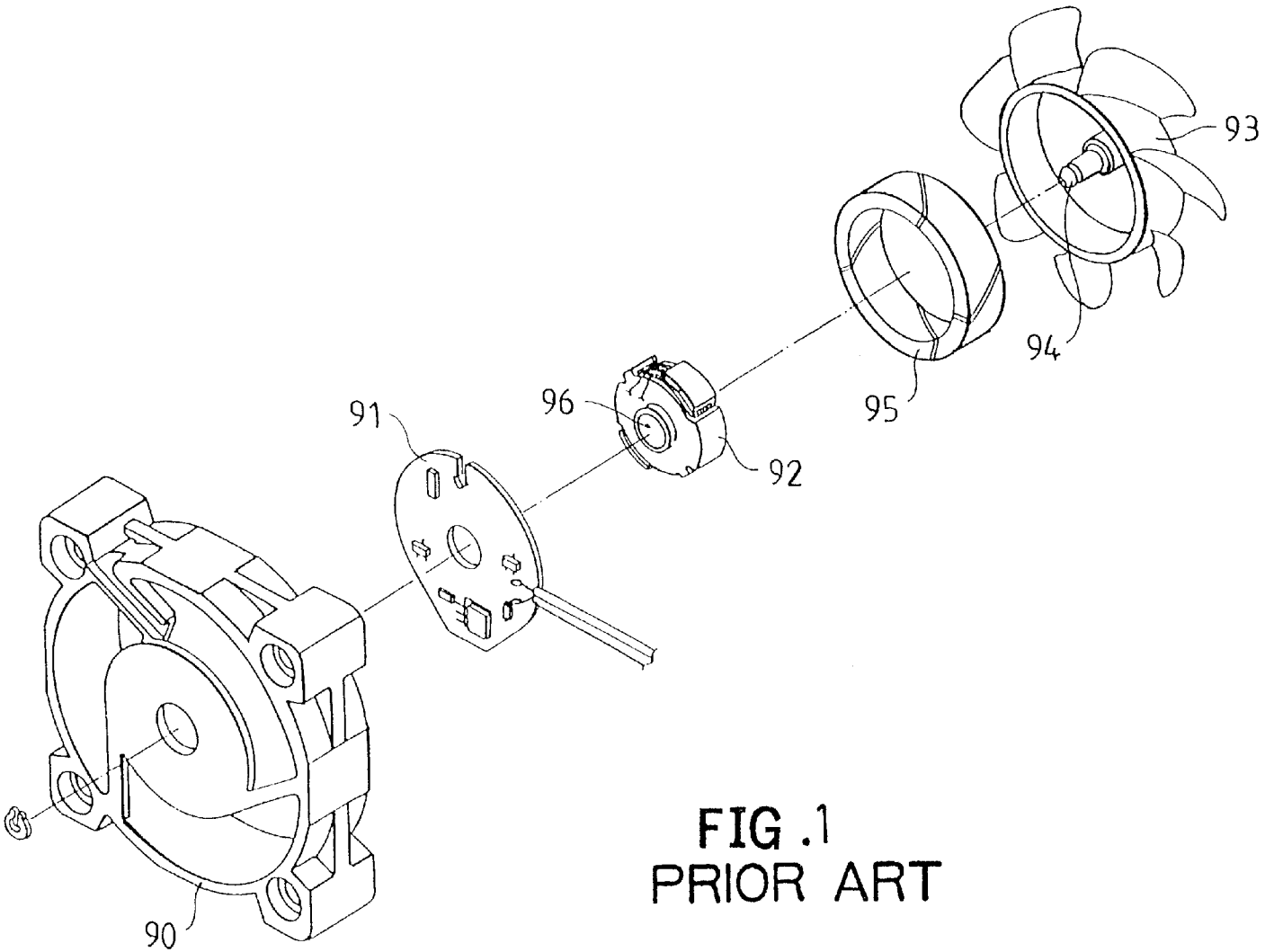
FIG. 1 PRIOR ART
FIG. 1 is an exploded perspective view of a conventional heat dissipation fan structure in accordance with the prior art.
Figure 2:
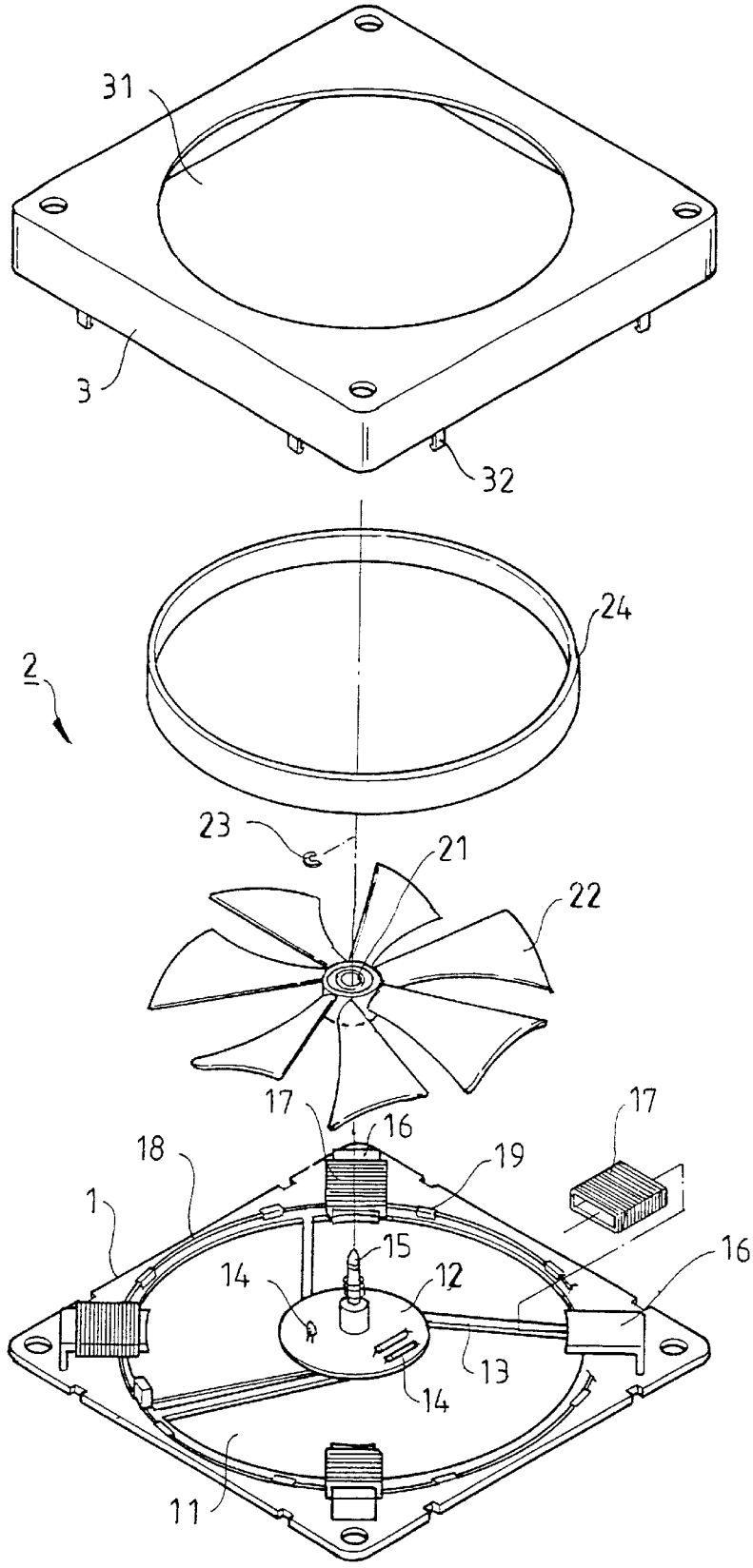
FIG. 2 is an exploded perspective view of a heat dissipation fan structure in accordance with a first embodiment of the present invention.

Referring to the drawings and initially to FIG. 2, a heat dissipation fan structure in accordance with a first embodiment of the present invention comprises a base plate 1, an impeller 2, and an outer frame 3.

The base plate 1 may be made of plastic or metallic material, and is preferably made of plastic, thereby reducing the cost of fabrication. The base plate 1 is provided with an air outlet 11 which is provided with a bottom plate 12, and a plurality of support bars 13 are connected between the base plate 1 and the bottom plate 12, to function as drawing slots of a power supply wire. The bottom plate 12 is provided with a drive circuit control member 14, and has a center provided with a shaft 15 on which a pivot member 21 (such as a bearing) of the impeller 2 may be pivoted, so that the impeller 2 is supported on the shaft 15 to rotate. The base plate 1 is provided with a plurality of poles 16 that may be made of material such as silicon steel plates or the like. The number of the poles 16 may be designed according to the practical requirement to have an even number, such as four, six, eight or the like. the poles 16 are arranged in an equally angular manner. In the preferred embodiment, four poles 16 are arranged at the four corners of the base plate 1. Thus, the space of the base plate 1 may be employed optimally, and the blades 22 of the impeller 2 may form a larger design. Each pole 16 is wound with a coil 17, and an insulating material is mounted between the pole 16 and the coil 17. Poles having the same polarity may be connected by the connecting wire 18. The connecting wire 18 may be fixed on the base plate 1 by fixing members 19 such as hooks or the like, thereby preventing the wire 18 from being tangled with the blades 22 of the impeller 2.

The impeller 2 has a center defining an axial hole for receiving the pivot member 21 such as a bearing. The pivot member 21 may be pivoted with the shaft 15 of the base plate 1. The shaft 15 is snapped by a snap member 23 such as a C-shaped ring, thereby preventing the impeller 2 from detaching from the shaft 15. The impeller 2 is provided with a plurality o blades 22, and a magnet ring 24 is mounted on the peripheral edges of the blades 22. The magnet ring 24 may be integrally formed with the blades 22, or combined with the blades 22 by a bonding manner. The magnet ring 24 may be induced with the poles 16 of the base plate 1 in an attractive or repulsive manner, thereby driving the impeller 2 to rotate.

Preferably, the base plate 1 may be combined with the outer frame 3, thereby preventing foreign objects entering the impeller 2 to strike the blades 22. As shown in the figure, the outer frame 3 may be secured on the base plate 1 by hooks 32. The outer frame 3 defines an air inlet 31.

Figure 3:
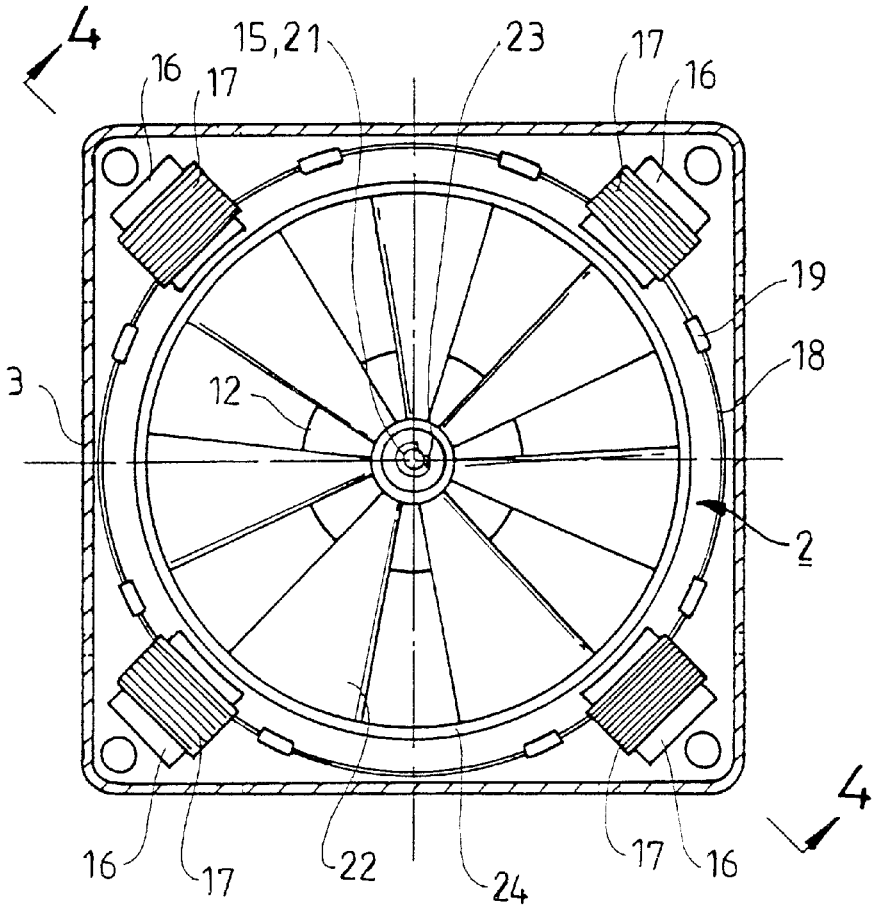
FIG. 3 is a top plan cross-sectional assembly view of the heat dissipation fan structure as shown in FIG. 2.
Figure 4:
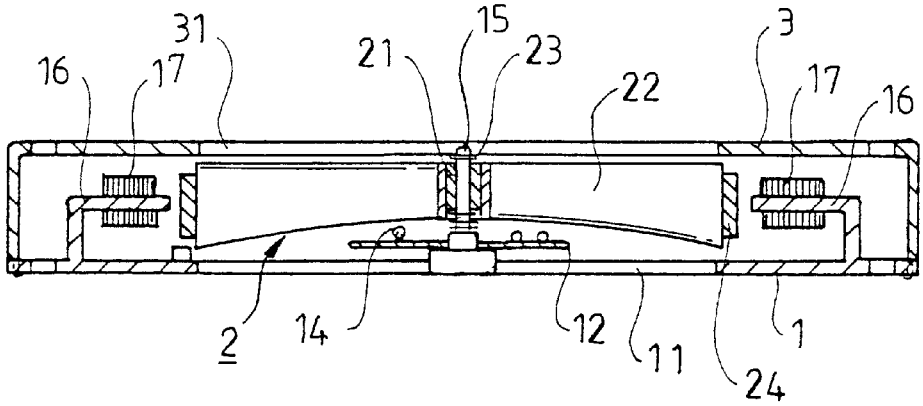
FIG. 4 is a cross-sectional view of the heat dissipation fan structure along line 4—4 as shown in FIG. 3.

Referring now to FIGS. 3 and 4, the parts of the heat dissipation fan structure in accordance with the first embodiment of the present invention are assembled. The pivot member 21 of the impeller 2 is pivoted on the shaft 15 of the base plate 1. The poles 16 wound with the coils 17 encompass the outer periphery of the magnet ring 24. Thus, when the electric power is supplied into the coils 17, the impeller 2 is driven to rotate by control of the drive circuit control member 14.

Figure 5:
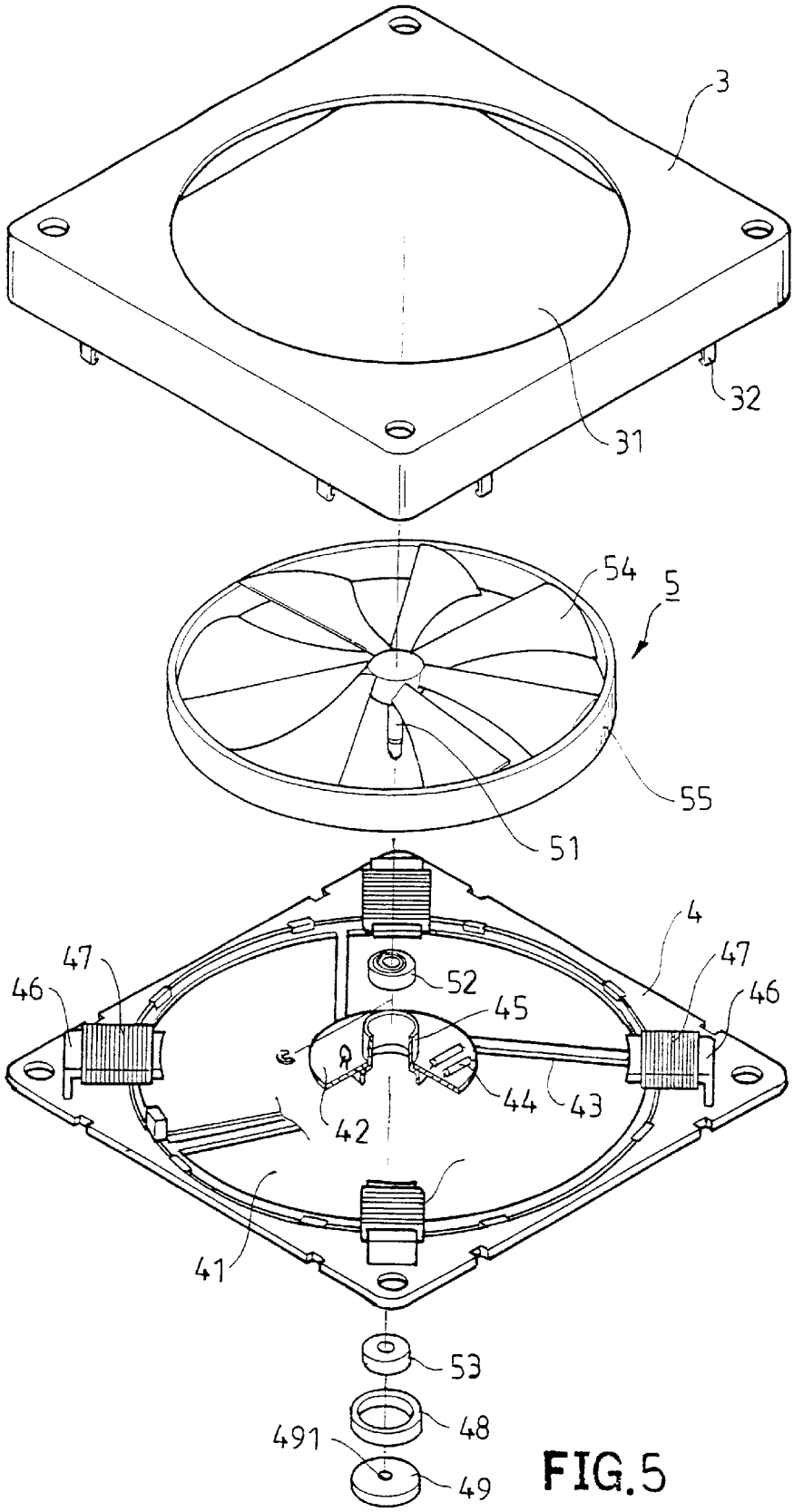
FIG. 5 is an exploded perspective view of a heat dissipation fan structure in accordance with a second embodiment of the present invention.

Referring to FIG. 5, a heat dissipation fan structure in accordance with a second embodiment of the present invention comprises a base plate 4, an impeller 5, and an outer frame 3.

The base plate 4 is provided with an air outlet 41 which is provided with a bottom plate 42, and a plurality of support bars 43 are connected between the base plate 4 and the bottom plate 42, to function as drawing slots of a power supply wire. The bottom plate 42 is provided with a drive circuit control member 44, and has a center provided with a shaft tube 45 on which a pivot member 52 such as a bearing may be pivoted, so that the impeller 5 is supported on the shaft tube 45 to rotate. The base plate 4 is provided with a plurality of poles 46 that may be made of material such as silicon steel plates or the like. Each pole 46 is wound with a coil 47, and an insulating material is mounted between the pole 46 and the coil 47. An outer ring 48 is fixed in the shaft tube 45, so that the impeller 5 may be rotated more stably. The outer ring 48 may be a ring made of magnetic conducting material, or be a permanent magnet, or be made by winding a metallic coil. The outer ring 48 may also be a coil supplied with the electric power. A closure plate 49 may be used to close the end face of the shaft tube 45. The central position of the closure plate 49 is formed with an arcuate depression 491.

The impeller 5 has a center provided with a central shaft 51 which is pivoted on the pivot member (bearing) 52 that is fixed in the shaft tube 45 of the base plate 4. After the central shaft 51 is passed through the pivot member (bearing) 52, an inner ring 53 is mounted on the central shaft 51. The inner ring 53 may be a ring made of magnetic conducting material, or be a permanent magnet, and the inner ring 53 corresponds to the outer ring 48 that is fixed in the shaft tube 45. The impeller 5 is provided with a plurality of blades 54, and a magnet ring 55 is combined on the peripheral edges of the blades 54. The magnet ring 55 may be induced with the poles 46 of the base plate 4 in an attractive or repulsive manner, thereby driving the impeller 5 to rotate.

Preferably, the base plate 4 may be combined with the outer frame 3, thereby preventing foreign objects entering the impeller 5 to strike the blades 54. As shown in the figure, the outer frame 3 may be secured on the base plate 4 by hooks 32. The outer frame 3 defines an air inlet 31.

Figure 6:
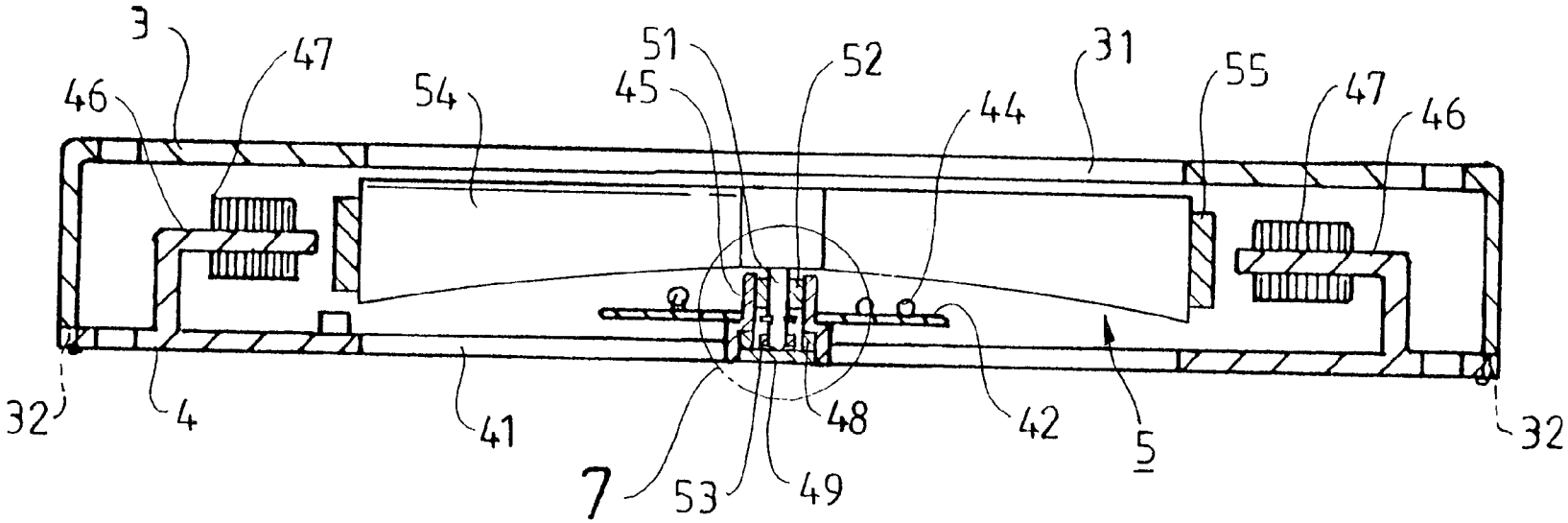
FIG. 6 is a front plan cross-sectional assembly view of the heat dissipation fan structure as shown in FIG. 5.
Figure 7:
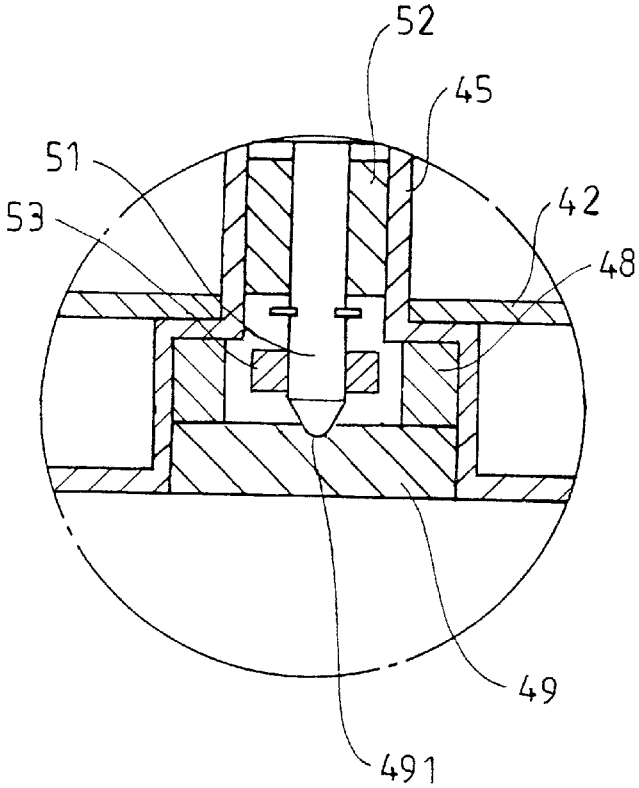
FIG. 7 is a locally enlarged view of the heat dissipation fan structure as shown in FIG. 6.
Figure 8:
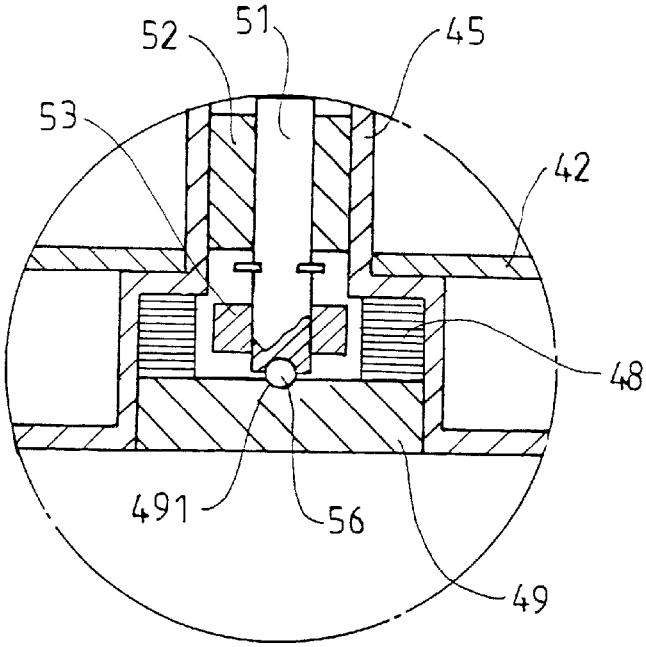
FIG. 8 is a locally enlarged view of the heat dissipation fan structure in accordance with another embodiment of the present invention.

Referring to FIG. 6, the parts of the heat dissipation fan structure in accordance with a second embodiment of the present invention are assembled. The central shaft 5 1 of the impeller 5 is pivoted in the pivot member (bearing) 52 of the shaft tube 45, and the central shaft 51 passing through the pivot member (bearing) 52 is additionally provided with an inner ring 53 which corresponds to the outer ring 48 that is fixed in the shaft tube 45. The end face of the central shaft 51 is rested on the arcuate depression 491 of the closure plate 49 as shown in FIG. 7. If necessary, a ball 56 may be mounted between the end face of the central shaft 51 is rested on the arcuate depression 491 of the closure plate 49 as shown in FIG. 8, so that the impeller 5 may be rotated more stably.

In addition, the outer ring 48 and the inner ring 53 may be permanent magnets. Thus, when the impeller 5 is rotated, the magnet ring 55 may be induced with the poles 46 wound with the coils 47 to drive the impeller 5 to rotate, while the outer ring 48 may also be induced and attracted with the inner ring 53, so that the impeller 5 may be rotated more stably.

In addition, the outer ring 48 may be a coil supplied with the electric current, and the inner ring 53 may be a permanent magnet. Thus, when the impeller 5 is rotated, a relative movement produces between the inner ring 53 and the outer ring 48. In other words, the magnetic field of the inner ring 53 made of a permanent magnet and the outer ring 48 formed by a coil supplied with the electric current will produce a cutting effect of the magnet field. Thus, the outer ring 48 itself will produce an electromotive force (e.m.f.). The coil of the outer ring 48 has a drawing wire that may be drawn outward to connect other device, such as a control circuit, an indication circuit or a warning circuit, so as to detect if the impeller 5 is operated and rotated normally.

Accordingly, in accordance with the present invention, the sensing coils and the poles are mounted on the base plate, and the sensing magnet ring of the impeller is mounted on the peripheral edges of the blades. Thus, the winding of the coil may be made more conveniently, and the thickness of the impeller may become smaller. Especially, when the coils and the poles are mounted on the four comers of the base plate, the space between the base plate and the outer frame may be fully utilized. At the same time, the length of the blade of the impeller may be increased without changing the size of the base plate, thereby increasing the air inlet amount. Alternatively, the size of the base plate may be shortened without changing the air inlet amount, such that the volume of the entire heat dissipation fan structure may be made thin and small.

In addition, in accordance with the present invention, the central shaft of the impeller is rested on the arcuate depression of the closure plate of the base plate, so that rotation of the impeller is more rigid and stable. Further, the central shaft and the shaft tube are provided with corresponding inner ring and outer ring. When either one of the inner ring and the outer ring is made of a permanent magnet, the impeller may be rotated more rigidly and stably. Further, the outer ring may be a coil supplied with an electric current, and the inner ring may be a permanent magnet. Thus, when the impeller is rotated, a relative movement produces between the inner ring and the outer ring, thereby producing a cutting effect of the magnet field, so that the outer ring will produce an electromotive force which may be used to detect if the impeller is operated and rotated normally, thereby achieving a detection function.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A heat dissipation fan structure, comprising:

a base plate, provided with an air outlet which is provided with a bottom plate, the bottom plate provided with a shaft for supporting an impeller to rotate, the bottom plate provided with a drive circuit control member, for driving the impeller to rotate, the base plate provided with a plurality of poles of an even number, each pole being wound with a coil, an insulating layer mounted between the pole and the coil, poles having the same polarity being connected by a connecting wire;

the impeller, including a bearing pivoted and rotated on the shaft of the bottom plate, the impeller having a plurality of blades that may drive air to flow, a magnet ring mounted on peripheral edges of the blades, the magnet ring being induced with the poles wound with coils.

2. The heat dissipation fan structure as claimed in claim 1, further comprising an outer frame combined with the base plate, for encompassing the impeller, the outer frame having an air inlet.

3. A heat dissipation fan structure, comprising:

a base plate, provided with an air outlet which is provided with a bottom plate, the bottom plate provided with a shaft tube and a drive circuit control member, a bearing fixed in the shaft tube, the base plate provided with a plurality of poles of an even number, each pole being wound with a coil, an insulating layer mounted between the pole and the coil, poles having the same polarity being connected by a connecting wire; and an impeller, including a central shaft pivoted and rotated in the bearing of the shaft tube of the bottom plate, the impeller having a plurality of blades that may drive air to flow, a magnet ring mounted on peripheral edges of the blades, the magnet ring being induced with the poles wound with coils.

4. The heat dissipation fan structure as claimed in claim 3, further comprising an outer frame combined with the base plate, for encompassing the impeller, the outer frame having an air inlet.

5. The heat dissipation fan structure as claimed in claim 3, wherein the central shaft of the impeller is passed through the bearing, and is combined with an inner ring, an outer ring is mounted in an inner wall of the shaft tube to correspond to the inner ring, at least one of the inner ring and the outer ring being a permanent magnet, and the other being a ring made of a magnetic conducting material, the inner ring and the outer ring capable of attracting each other.

6. The heat dissipation fan structure as claimed in claim 3, further comprising a closure plate for closing an end face of the shaft tube, wherein the central shaft of the impeller has an end face is rested on the closure plate.

7. The heat dissipation fan structure as claimed in claim 6, further comprising a ball mounted between the end face of the central shaft of the impeller and the closure plate.

8. The heat dissipation fan structure as claimed in claim 3, wherein the central shaft of the impeller is passed through the bearing, and is combined with an inner ring, an outer ring is mounted in an inner wall of the shaft tube to correspond to the inner ring, the inner ring being a permanent magnet, the outer ring being a coil supplied with an electric current, a relative movement produces between the inner ring and the outer ring, so that the outer ring produces an electromotive force which is used to detect if the impeller is operated and rotated normally.

9. The heat dissipation fan structure as claimed in claim 8, wherein the coil has a drawing wire externally connected to an indication circuit or a warning circuit.

10. The heat dissipation fan structure as claimed in claim 8, wherein the coil has a drawing wire externally connected to an indication light or a buzzer.

* * * * *